US007994980B2

(12) United States Patent
Son et al.

(10) Patent No.: US 7,994,980 B2
(45) Date of Patent: Aug. 9, 2011

(54) APPARATUS FOR CORRECTING PHASE OF PHASED ARRAY ANTENNA AND METHOD THEREOF

(75) Inventors: Seong-Ho Son, Busan (KR); Soon-Young Eom, Daejon (KR); Soon-Ik Jeon, Daejon (KR); Woon-Bong Hwang, Gyeongbuk (KR)

(73) Assignees: Electronics and Telecommunications Research Institute, Daejon (KR); Postech Academy-Industry Foundation, Gyeongbuk (KR)

( * ) Notice: Subject to any disclaimer, the term of this patent is extended or adjusted under 35 U.S.C. 154(b) by 226 days.

(21) Appl. No.: 12/136,678

(22) Filed: Jun. 10, 2008

(65) Prior Publication Data

US 2009/0315774 A1 Dec. 24, 2009

(30) Foreign Application Priority Data

Sep. 20, 2007 (KR) ..... 10-2007-0095747

(51) Int. Cl.
*H01Q 3/00* (2006.01)

(52) U.S. Cl. ..... 342/372

(58) Field of Classification Search ..... 342/165, 342/169, 174, 368, 371, 372
See application file for complete search history.

(56) References Cited

U.S. PATENT DOCUMENTS

| | | | | |
|---|---|---|---|---|
| 4,268,829 | A * | 5/1981 | Baurle et al. | 342/380 |
| 4,533,873 | A * | 8/1985 | Alcock | 327/236 |
| 5,027,127 | A * | 6/1991 | Shnitkin et al. | 342/372 |
| 5,712,642 | A * | 1/1998 | Hulderman | 342/372 |

FOREIGN PATENT DOCUMENTS

| | | | |
|---|---|---|---|
| JP | 10-2000-0052485 | A | 8/2000 |
| JP | 10-2004-0016490 | A | 2/2004 |
| KR | 10-2004-0076760 | A | 8/2001 |
| KR | 2003-0007680 | | 1/2003 |
| KR | 10-2005-0001827 | A | 1/2005 |
| KR | 10-20050066796 | A | 6/2005 |
| KR | 2005-0067338 | A | 7/2005 |

OTHER PUBLICATIONS

Son, Seong Ho et al., "Gain Enhancement of Large Phased Array Antennas by Phase Error Correction", IEEE AP-S International Symposium 2007, Jun. 2007.

Y. Kuwahara, "Phased Array Antenna with Temperature Compensating Capability", IEEE International Symposium on Phased Array Systems and Technology, pp. 21-26, Oct. 1996.

Herbert M. Aumann et al., "Phased Array Antenna Calibration and Pattern Prediction Using Mutual Coupling Measurements", IEEE Transactions on Antennas and Propagation, vol. 37, No. 7, pp. 844-850, Jul. 1989.

* cited by examiner

*Primary Examiner* — Dao L Phan
(74) *Attorney, Agent, or Firm* — Rabin & Berdo, PC

(57) ABSTRACT

Provided are an apparatus for correcting a phase of a phased array antenna and a method thereof. The apparatus for correcting a phase of a phased array antenna for receiving a radio signal, includes a phased array antenna for receiving radio signals from a reference antenna and combining power of the received radio signals, a power dividing unit for dividing the combined power of the received radio signals, a voltage detecting unit for detecting voltage values of the divided radio signals, and a phase controlling unit for estimating a phase error that makes the detected voltage value maximum and controlling a phase of each radiation element of the phased array antenna using the estimated phase error.

13 Claims, 7 Drawing Sheets

APPARATUS FOR CORRECTING PHASE OF PHASED ARRAY ANTENNA AND METHOD THEREOF

BACKGROUND OF THE INVENTION

1. Field of the Invention

The present invention relates to an apparatus for correcting a phase of a phased array antenna and a method thereof; and, more particularly, to an apparatus for correcting a phase of a phased array antenna and a method thereof, which detect overall power intensity of a received signal, and estimates and corrects a phase error of each radiation element to maximize the detected power intensity.

The present invention also relates to a method for correcting a phase error of a phased array antenna and detecting a arrival direction of a radio signal.

The present invention also relates to a genetic algorithm for detecting a phase error to maximize a voltage value.

This work was supported by the IT R&D program of MIC/IITA [2007-F-041-01, "Intelligent Antenna Technology Development"].

2. Description of Related Art

Hereinafter, a basic theory of a genetic algorithm will be described.

In nature, populations have been evolving for many years. Each of the populations is a set of individuals of a predetermined generation, and predetermined individuals having high fitness for a given environment have the large chance to survive and to reproduce among the populations. Here, populations of the next generation may be created through crossover and mutation.

In a genetic algorithm (GA), the number of individuals is referred as a population size. Each individual has chromosome formed of a plurality of genes. A locus is a position that a given gene occupies on a chromosome. An allele is one member of a pair or series of genes that occupy a predetermined position on a predetermined chromosome. Characteristics of a predetermined population are decided by chromosomes. For example, a person has black hair because the person has a predetermined chromosome combination of black hair characteristic.

An allele that is decided by genes is referred as phenotype, and a corresponding chromosome structure is referred as a genotype. A complicated form of the phenotype is decided by a plurality of locuses. The complicated form of the phenotype is referred as epistasis. Converting phenotype to genotype is referred as coding, and converting genotype to phenotype is referred as decoding.

Such biological evolution has been imitated and artificially modeled to an algorithm. Such an algorithm is referred as a genetic algorithm.

The genetic algorithm is one type of a solution search method and an optimization method. That is, a solution set is formed by encoding a solution for a given problem to an individual, and a population is formed with the individuals. Then, a new solution is generated through crossover and mutation of individuals, and a fitness of the new solution is analyzed, thereby generating an optimal solution. Ending conditions of the genetic algorithm may be if evolution has been progressed for the predetermined number of generations, if fitness has not been improved for the plurality of generations, or if fitness becomes higher than a predetermined threshold.

The genetic algorithm has been used to find an optimal solution for a Non-Linear Problem (NLP), a Nondeterministic Polynomial time—Complete problem (NP-complete), and Nondeterministic polynomial time—hard problem (NP-Hard), which have been known as non-solvable problems or problems with high computational complexity.

The generic algorithm includes exploration for exploring an unknown area and exploitation for obtaining valid information. Therefore, the harmony of exploration and exploitation is very important for obtaining an optimal solution of a problem. Using the obtained information is very similar to hill-climbing. Also, the generic algorithm has the same characteristics of random search as exploration is emphasized more.

The genetic algorithm is an algorithm that can control the above two conditions, the exploration and the exploitation, together. A population size M, a probability of crossover pc and a probability of mutation pm are major parameters for controlling the two conditions.

Since high probabilities of crossover and mutation ps and ms improve exploration ability, it is advantageous to find a search area having high fitness at an initial stage. However, the high probabilities of crossover and mutation ps and ms deteriorate exploitation ability, thereby decreasing a convergence speed of converging a good solution to an optimal solution in a search space after finding a predetermined level of the good solution. Here, the low probabilities of crossover and mutation pc and pm have the opposite characteristics.

If a population size M is small, it is possible to reduce a time for calculating fitness. However, a solution may be converged before calculating the optimal solution due to fast loss of diversity of individuals. On the contrary, if the population size M is large, a probability of reaching an optimal solution is high too. However, a large memory space and a long calculating time are required. A method for deciding an optimal population size that satisfies the performance evaluation factors may differ according to the characteristic of a problem and other control parameters.

A phased array antenna includes a plurality of active elements. That is, a plurality of array radiation elements, a shifter, an attenuator, and a low noise amplifier/high power amplifier, and a combiner/divider are connected through a coaxial cable in the phased array antenna.

All of phased array antennas have a relative phase error due to path difference of each channel. Also, a position error of array radiation element is generated due to manufacture processes or deformation. These errors act as comparative phase errors for each channel of array element, thereby causing antenna gain reduction, side lobe increment, and primary beam polarization.

Therefore, there have been demands for developing a method for automatically correcting a phase error of each channel at high speed in a phased array antenna.

In order to correct the phase error of the phased array antenna, a method for finding a phase correction value from all bit combinations to optimize a radiation pattern for a phased array antenna having a digital phase shifter was introduced.

However, this method needs a long time to find a phase correction value although the number of array elements is only about 10. Also, it is impossible to use this method for an analog phase shifter.

In order to overcome such shortcomings, another method was introduced. In this method, one radiation element is turned on and the others are turned off. Then, a phase of each channel having the turned-on radiation element is measured using a network analyzer. A correction value is calculated based on the measured value.

However, it is difficult to use the network analyzer if a phased array antenna is big because a distance for satisfying a far-field condition may be longer than several tens meters.

Furthermore, a method for correcting a phase error caused by temperature in an array antenna was introduced in an article by 'Y. Kuwahara', entitled 'Phased Array Antenna with Temperature Compensating Capability', IEEE International Symposium on Phased Array Systems and Technology, pp. 21-26, October 1996.

Moreover, another method for correcting a phase is introduced in an article by 'H. M. Aumann' et. al., entitled 'Phased Array Antenna Calibration and Pattern Prediction Using Mutual Coupling Measurement' IEEE Transactions on Antennas and Propagation, vol. 37, no. 7, pp. 844-850, July 1999.

However, these methods require long time and great labor to correct the phase error. Therefore, there is limitation to use such methods for a phase array antenna having a plurality of radiation elements. That is, these methods according to the related art have low efficiency when these methods are applied for a phased array antenna having a plurality of radiation elements.

SUMMARY OF THE INVENTION

An embodiment of the present invention is directed to providing an apparatus and method for instantly and efficiently correcting a phase error by receiving a radio signal from a reference antenna through a phased array antenna for receiving, detecting an overall power intensity (voltage) of a received signal, and estimating a phase error of each radiation element, which maximizes the detected power intensity.

Another embodiment of the present invention is directed to providing an apparatus and method for instantly and efficiently correcting a phase error by receiving a radio signal radiated from a phased array antenna for transmitting through a reference antenna, detecting an overall power intensity (voltage) of a received signal, and estimating a phase error of each radiation element, which maximizes the detected power intensity.

Another embodiment of the present invention is directed to providing an apparatus and method for correcting a phase of a phased array antenna, which detect overall power intensity (voltage) of a received signal, estimate a phase error of each radiation element that maximizes the detected power intensity, and compensate a phase based on the estimated phase error.

In accordance with an aspect of the present invention, there is provided an apparatus for correcting a phase of a phased array antenna for receiving a radio signal, including: a phased array antenna for receiving radio signals from a reference antenna and combining power of the received radio signals; a power dividing unit for dividing the combined power of the received radio signals; a voltage detecting unit for detecting voltage values of the divided radio signals; and a phase controlling unit for estimating a phase error that makes the detected voltage value maximum and controlling a phase of each radiation element of the phased array antenna using the estimated phase error.

In accordance with another aspect of the present invention, there is provided an apparatus for correcting a phase of a phased array antenna for transmitting a radio signal, including: a phased array antenna for transmitting radio signals; a reference antenna for receiving the radio signal transmitted from the phased array antenna for transmitting; a voltage detecting unit for detecting voltage values of the radio signal received at the reference antenna; and a phase controlling unit for estimating a phase error that makes the detected voltage value maximum and controlling a phase of each radiation element of the phased array antenna using the estimated phase error.

In accordance with still another aspect of the present invention, there is provided a method for correcting a phase of a phased array antenna, including: generating objects having phase information used for correcting the phase of the phased array antenna; correcting a phase error of the phased array antenna according to each of the phase information of the generated objects; detecting a voltage value of a signal passing through the corrected phase array antenna and determining whether a predetermined convergence condition is satisfied by the detected voltage value or not; deciding the phase information as a final phase correction value of the phased array antenna if the predetermined convergence condition is satisfied; and generating an object having new phase information using previously detected voltage values if the predetermined convergence condition is not satisfied and performing said correcting a phase error.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

DESCRIPTION OF SPECIFIC EMBODIMENTS

The advantages, features and aspects of the invention will become apparent from the following description of the embodiments with reference to the accompanying drawings, which is set forth hereinafter.

Figure 1:
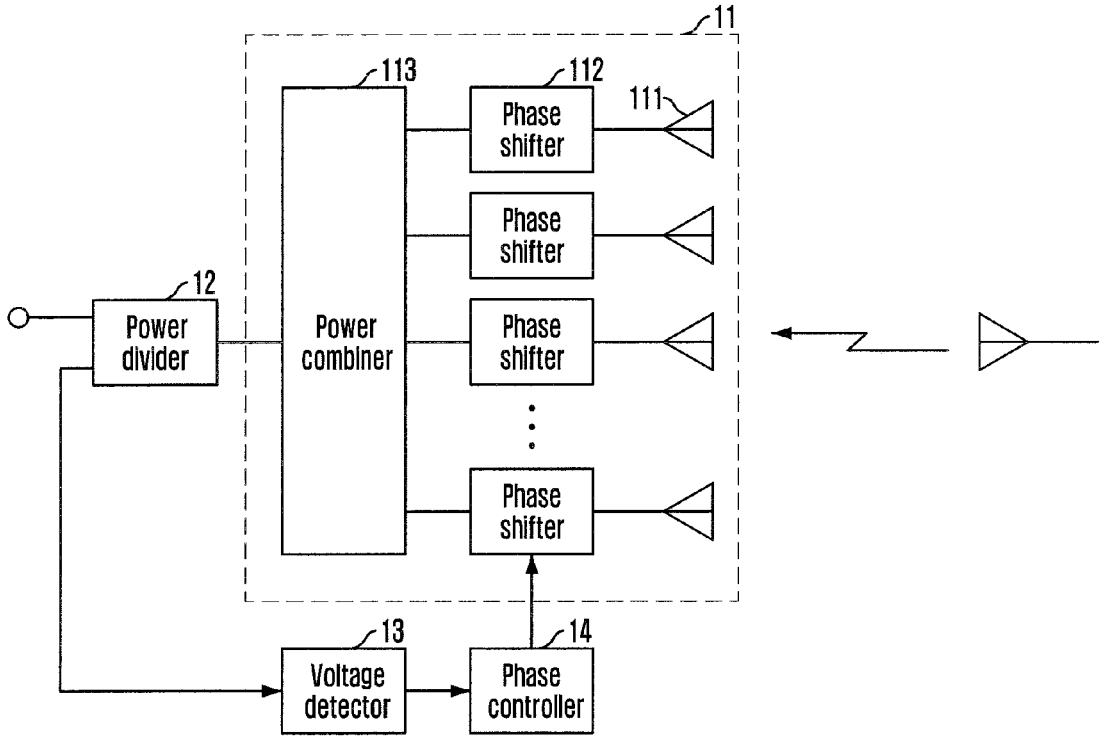
FIG. 1 is a diagram illustrating an apparatus for correcting a phase of a phased array antenna for receiving a radio signal in accordance with an embodiment of the present invention.

FIG. 1 is a diagram illustrating an apparatus for correcting a phase of a phased array antenna for receiving a radio signal in accordance with an embodiment of the present invention.

As shown in FIG. 1, the apparatus according to the present embodiment includes a phased array antenna 11, a power divider 12, a voltage detector 13, and a phase controller 14.

The phased array antenna 11 receives radio signals from a reference antenna through a plurality of radiation elements and combining power of the received radio signals. The power divider 12 divides the power of the combined signal from the phased array antenna 11. The voltage detector 13 detects a voltage value of the divided signals from the power divider 12. The phase controller 14 estimates a phase error that maximizes the detected voltage value. That is, the phase controller 14 estimates a phase error of each radiation element of the phased array antenna 11. Then, the phase controller 14 controls the phase of each radiation element of the phased array antenna 11 using the estimated phase error.

The phased array antenna 11 includes a plurality of radiation elements 111 for receiving radio signals from a reference antenna, a plurality of phase shifters 112 for shifting phases of the received radio signals in response to control of the phase controller 14, and a power combiner 13 for combining power of each of the phase-shifted radio signals.

The phase controller 14 corrects an phase error of the phased array antenna 11 by randomly generating objects having phase information. The phase controller 14 also determines whether convergence condition is satisfied or not after detecting total voltage value of the received signals from the phased array antenna 11 and decides the phase information as a final phase correction value if the convergence conditions are satisfied. If not, the phase controller 14 selects the predetermined number of voltage values from previously detected voltage values in descending order from the largest voltage value, generates an object having new phase information by crossbreeding the selected voltage values, and repeats the above operations from the phase error correction step.

The phase controller 14 determines that the convergence condition is satisfied if a difference between a current voltage value and a previous voltage value is in an allowable error range. Also, the phase controller 14 determines that the convergence condition is not satisfied if a difference between a current voltage value and a previous voltage value is not in the allowable error range.

The reference antenna may be additionally disposed at the outside of the phased array antenna 11. Predetermined radiation elements of the phased array antenna may be used as the reference antenna, for example, a $1^{st}$ radiation element or a radiation element at the center.

Figure 2:
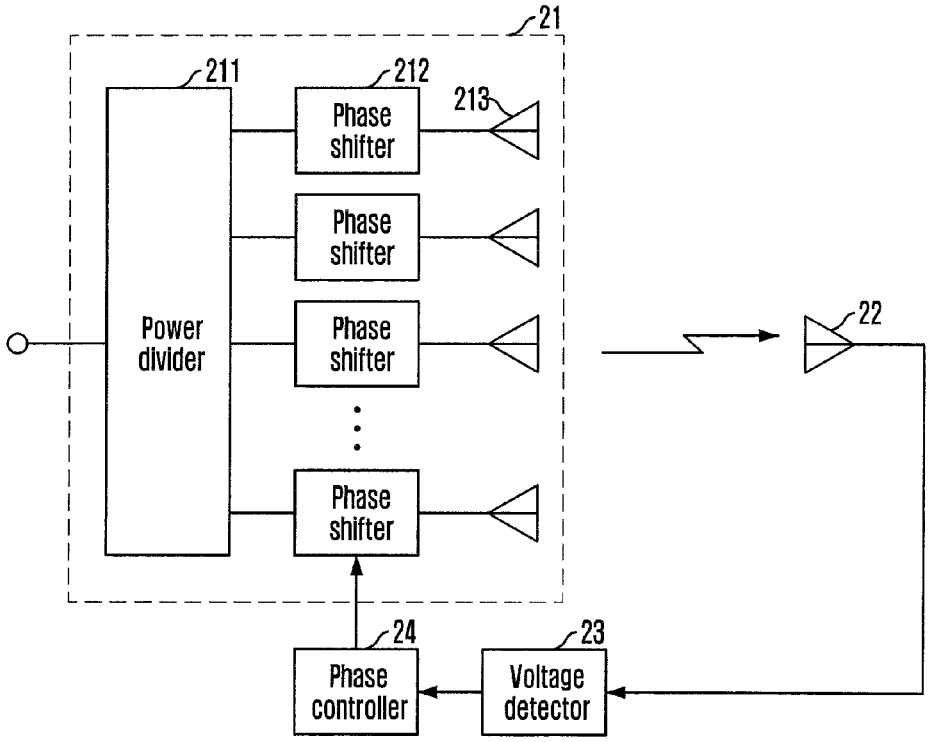
FIG. 2 is a diagram illustrating an apparatus for correcting a phase of a phased array antenna for transmitting a radio signal in accordance with an embodiment of the present invention.

FIG. 2 is a diagram illustrating an apparatus for correcting a phase of a phased array antenna for transmitting a radio signal in accordance with an embodiment of the present invention.

As shown in FIG. 2, the apparatus according to the present embodiment includes a phased array antenna 21 for transmitting a radio signal through a plurality of radiation elements, a reference antenna 22 for receiving a radio signal from the phase antenna 21, a voltage detector 23 for detecting a voltage value of a received radio signal from the reference antenna 22, and a phase controller 24. The phase controller 24 estimates a phase error that makes the detected voltage value from the voltage detector 23 maximum, which is equivalent to a phase error of each radiation element of the phased array antenna 21, and controls a phase of each radiation element using the estimated phase error.

The phased array antenna 21 also includes a power divider 211 for receiving a transmission signal and dividing the received signal into a plurality of power, a plurality of phase shifters 212 for shifting a phase of each of the divided signals from the power divider 211 in response to the phase controller 24, and a plurality of radiation elements 213 for radiating the phase-shifted transmitting signals from the plurality of phase shifters 212.

The phase controller 24 corrects a phase error of the phased array antenna 21 by randomly generating objects having phase information. The phase controller 24 also receives transmitted signals from the phased array antenna 21, detects voltage values of the received signals, and determines whether convergence condition is satisfied or not. If the convergence condition is satisfied, the phase controller 24 decides the phase information as a final phase correction value. If not, the phase controller 24 selects the predetermined number of voltage values, for example, three, from previously detected voltage values, and generates an object having new phase information by crossbreeding the selected voltage values. Then, the phase controller 24 repeats the above operations from the phase error correction step.

The phase controller 24 determines that the convergence condition is satisfied if a difference between a current voltage value and a previous voltage value is in an allowable error range. If not, the phase controller 24 determines that the convergence condition is not satisfied.

It is preferable that the reference antenna 22 is additionally disposed at the outside of the phased array antenna 21.

Figure 3:
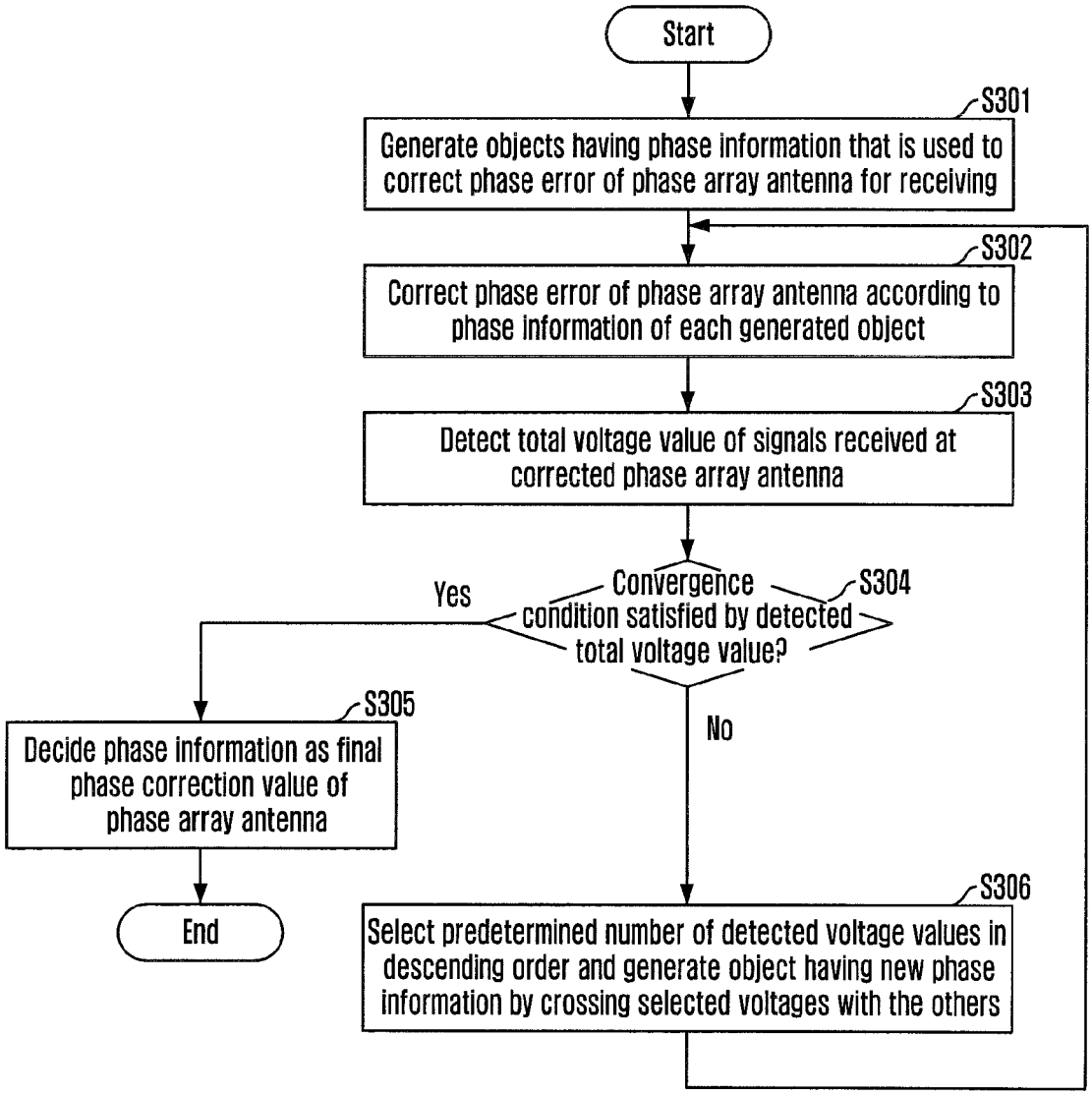
FIG. 3 is a flowchart for a method for correcting a phase of a phased array antenna for receiving a radio signal in accordance with an embodiment of the present invention.

FIG. 3 is a flowchart for a method for correcting a phase of a phased array antenna for receiving a radio signal in accordance with an embodiment of the present invention.

At step S301, objects having phase information used for correcting a phase error of the phased array antenna 11 are generated. Each of the objects is randomly generated, and the number of the generated objects is equal to the number of radiation elements of the phased array antenna 11 for receiving.

At step S302, a phase error of the phased array antenna is corrected according to the phase information of each of the generated objects.

At step S303, total voltage value is detected from the radio signals received through the phase-corrected phased array antenna.

At step S304, it is determined whether the detected voltage value is satisfied by convergence condition or not.

At step S305, the phase information is decided as a final phase correction value of the phased array antenna for receiving if the convergence condition is satisfied.

At step S306, the predetermined number of voltage values in descending order from the largest value from previously detected voltage values and an object having new phase information is generated by crossbreeding the selected voltage values if the convergence condition is not satisfied.

Then, the steps are repeated from the step S302.

In the step of determining whether the convergence condition is satisfied or not, it is determined that the convergence condition is satisfied if a difference between a current voltage value and a previous voltage value is in an allowable error range. If not, it is determined that the convergence condition is not satisfied. It is an effective method for determining the satisfaction of convergence condition when it is difficult to predict a converging point.

If it is easy to predict a converging point, it is possible to determine whether it is converged or not by setting up an error range based on the converging point.

Figure 4:
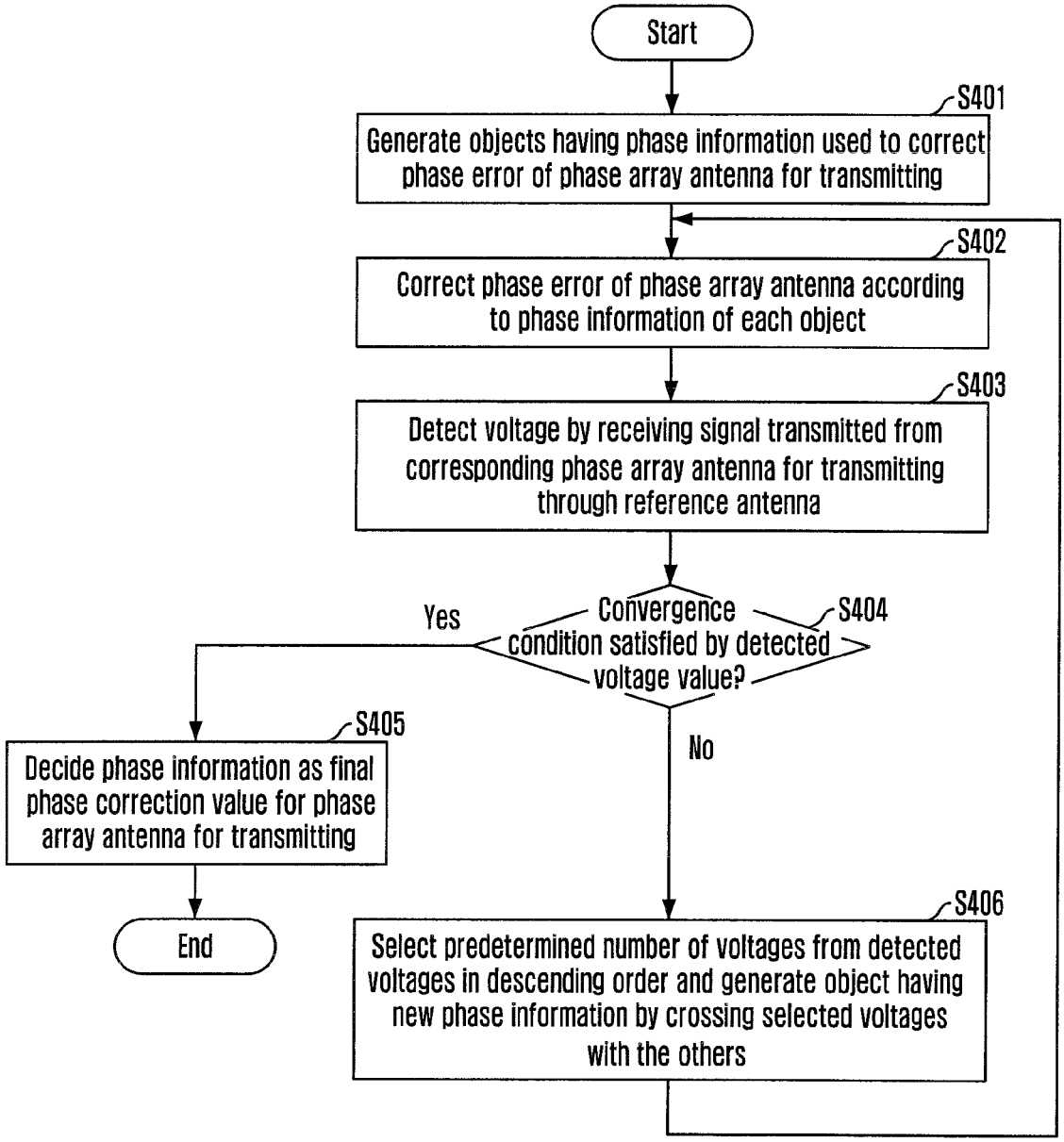
FIG. 4 is a flowchart illustrating a method for correcting a phase error of a phased array antenna for transmitting a radio signal in accordance with an embodiment of the present invention.

FIG. 4 is a flowchart illustrating a method for correcting a phase error of a phased array antenna for transmitting a radio signal in accordance with an embodiment of the present invention.

At step S401, objects having phase information used for correcting a phase error of the phased array antenna 21 are generated. Each of the objects is randomly generated, and the number of the generated objects is equal to the number of radiation elements of the phased array antenna 21 for receiving.

At step 402, a phase error of the phased array antenna for transmitting is corrected according to the phase information of each of the generated objects.

At step S403, total voltage value is detected from the radio signals received through the phase-corrected phased array antenna for transmitting.

At step S404, it is determined whether the detected voltage value is satisfied by convergence condition or not.

At step S405, the phase information is decided as a final phase correction value of the phased array antenna for transmitting if the convergence condition is satisfied.

At step S406, the predetermined voltage values are selected in descending order from the largest value from previously detected voltage values and an object having new phase information is generated by crossbreeding the selected voltage values if the convergence condition is not satisfied.

Then, the steps are repeated from the step S402.

In the step of determining whether the convergence condition is satisfied or not, it is determined that the convergence condition is satisfied if a difference between a current voltage value and a previous voltage value is in an allowable error range. If not, it is determined that the convergence condition is not satisfied. It is an effective method for determining the satisfaction of convergence condition when it is difficult to predict a converging point.

If it is easy to predict a converging point, it is possible to determine whether it is converged or not by setting up an error range based on the converging point.

Figure 5A:
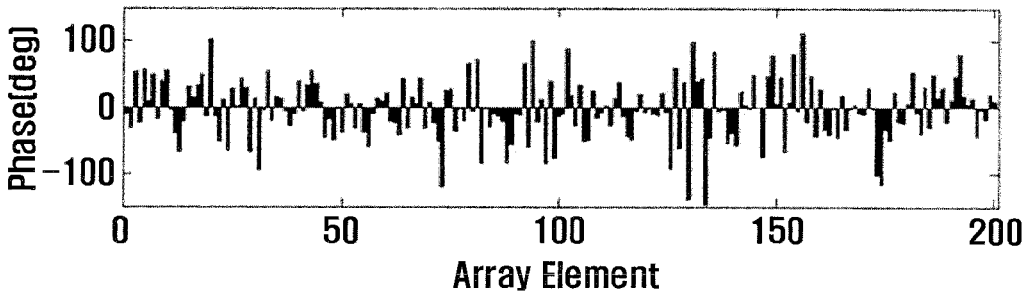
FIGS. 5A to 5C are graphs showing phase correction results, which are measured using an apparatus for correcting a phase error of a phased array antenna in accordance with an embodiment of the present invention.
Figure 5B:
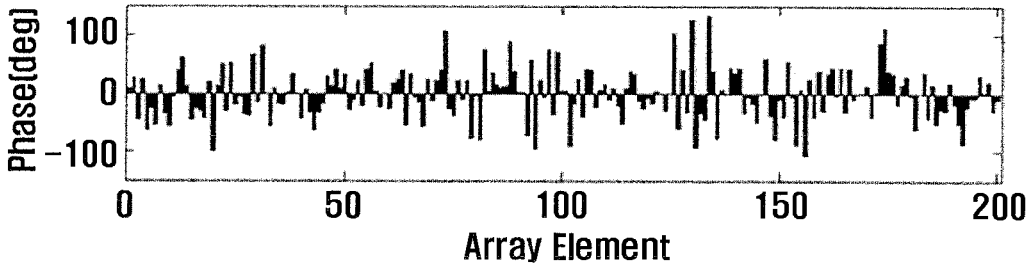
Figure 5C:
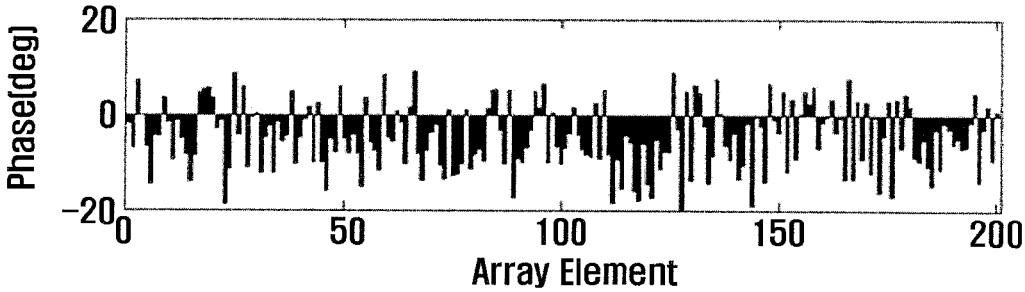

FIGS. 5A to 5C are graphs showing a result of correcting a phase, which is measured using an apparatus for correcting a phase error of a phased array antenna in accordance with an embodiment of the present invention. Here, the results are obtained using a plate phased array antenna having 200 (10× 20) radiation elements arranged at an interval of a half wave.

As shown in FIGS. 5A to 5C, a graph a) shows phase distribution in 200 channels, a graph b) shows a final decided phase correction value using the phase correcting apparatus according to the present invention, for example, analog shifter, and a graph c) shows a difference between each phase value in each channel and the final phase correction value decided according the present invention.

The graphs clearly show that a phase error is in a range of ±100 before correction and that a phase error is in a range of ±15 after correction.

Figure 6A:
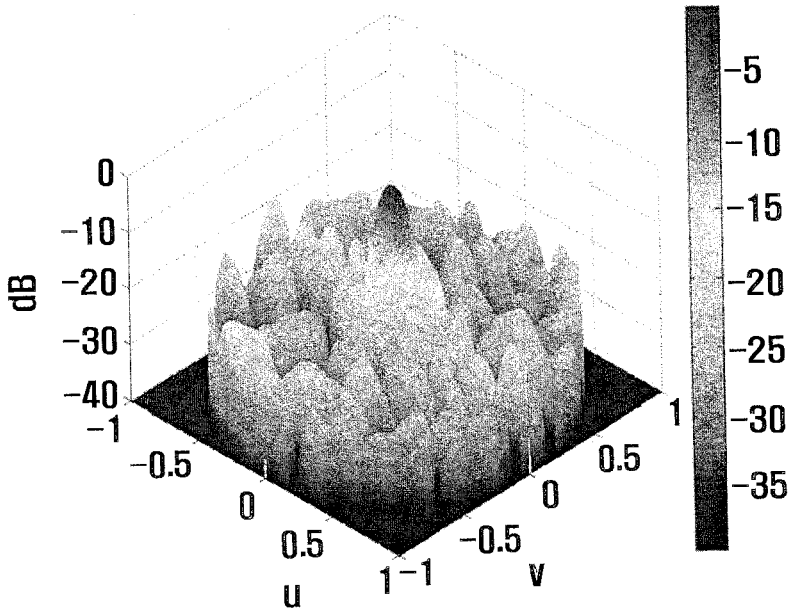
FIGS. 6A to 6C diagrams showing a phase correction result of an apparatus for correcting a phase error of a phased array antenna according to the present invention.
Figure 6B:
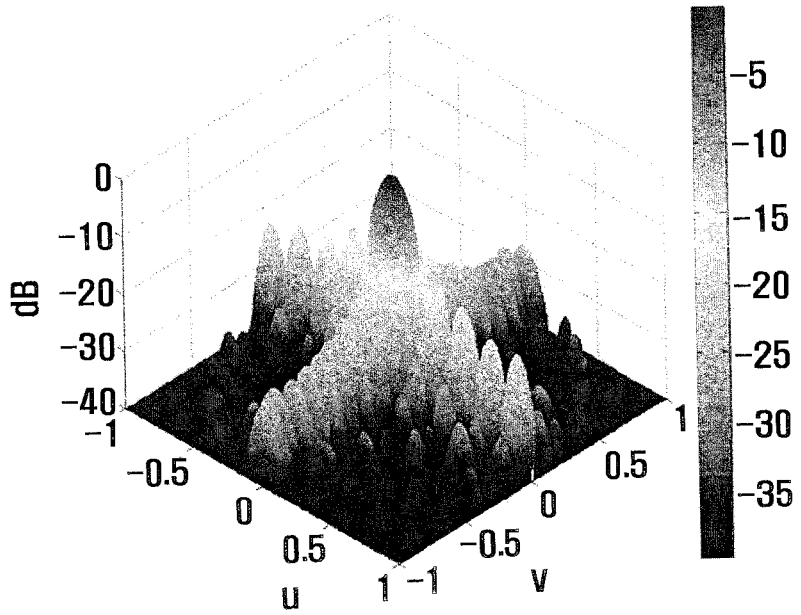
Figure 6C:
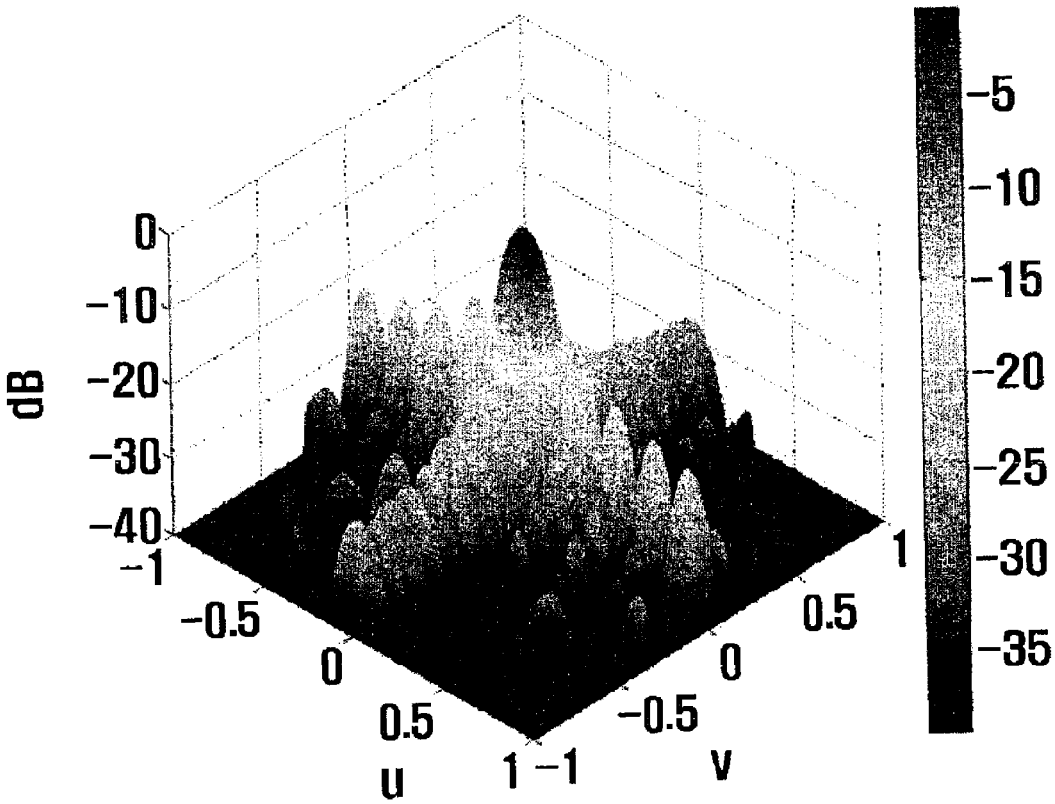

FIGS. 6A to 6C diagrams showing a phase correction result of an apparatus for correcting a phase error of a phased array antenna according to the present invention.

FIG. 6A shows antenna radiation pattern with a phase error, FIG. 6B shows antenna radiation pattern after correcting the phase error using the analog phase shifter according to the present embodiment, and FIG. 6C is an antenna radiation pattern after correcting a phase error using a 5-bit digital phase shifter.

Figure 7A:
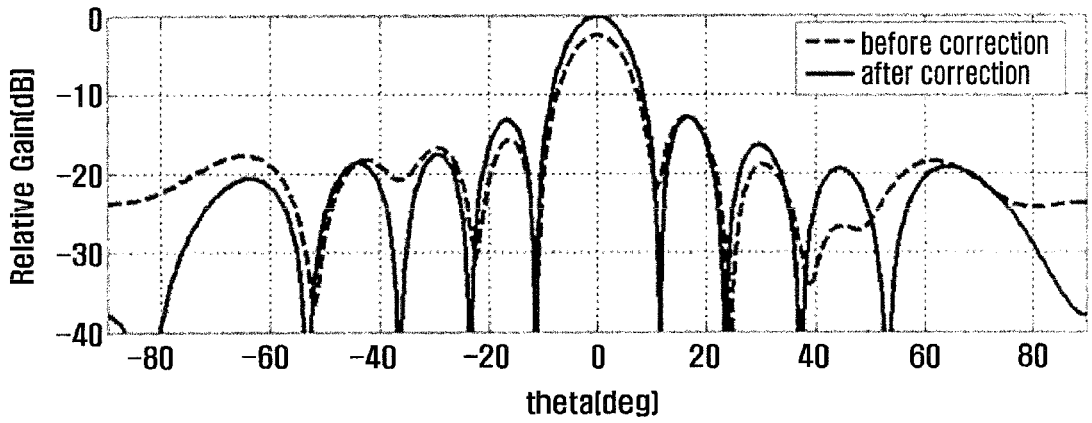
FIGS. 7A and 7B are graphs showing a phase correction result of an apparatus for correcting a phase error of a phased array antenna according to the present invention.
Figure 7B:
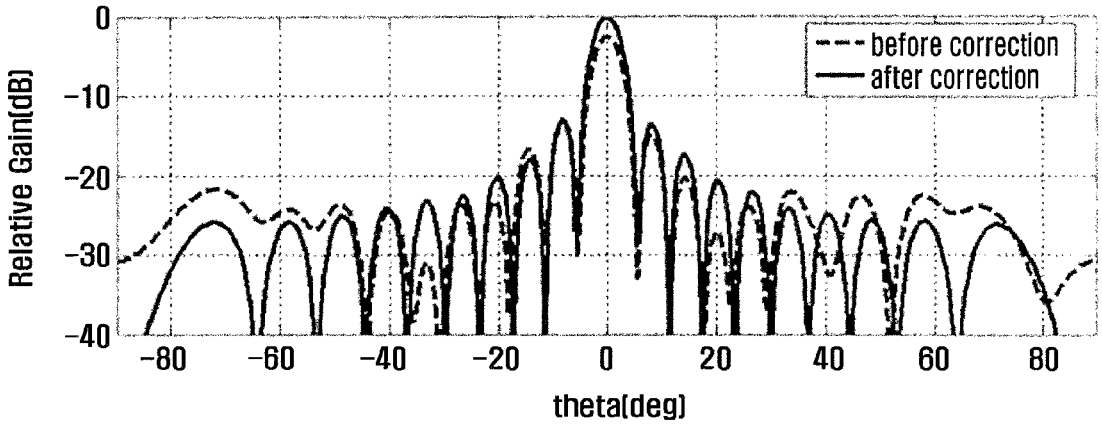

FIGS. 7A and 7B are graphs showing a phase correction result of an apparatus for correcting a phase error of a phased array antenna according to the present invention. That is, FIGS. 7A and 7B are cross-sectional views of the antenna radiation pattern of FIG. 6B.

As shown in FIGS. 7A and 7B, the graphs clearly show that antenna gain increases and average side lobe is reduced after correction.

The above described method according to the present invention can be embodied as a program and stored on a computer readable recording medium. The computer readable recording medium is any data storage device that can store data which can be thereafter read by the computer system. The computer readable recording medium includes a read-only memory (ROM), a random-access memory (RAM), a CD-ROM, a floppy disk, a hard disk and an optical magnetic disk.

The present application contains subject matter related to Korean Patent Application No. 10-2007-0095747, filed in the Korean Intellectual Property Office on Sep. 20, 2007, the entire contents of which is incorporated herein by reference.

While the present invention has been described with respect to the specific embodiments, it will be apparent to those skilled in the art that various changes and modifications may be made without departing from the spirit and scope of the invention as defined in the following claims.

As described above, the apparatus and method for correcting a phase according to the present invention can instantly and efficiently correct a phase error by detecting overall power intensity (voltage) of a received signal and estimating a phase error of each radiation element, which maximizes the detected power intensity.

The apparatus and method for correcting a phase according to the present invention can quickly, accurately, and automatically correct a phase error generated by physical differences such as electrical length differences of channels and position differences of radiation elements by observing only power intensity of a received signal from a phase array antenna.

The apparatus and method for correcting a phase according to the present invention can identically correct phase errors not only in a phased array antenna for receiving but also in a phased array antenna for transmitting.

The apparatus and method for correcting a phase according to the present invention can provide excellent correcting performance even for a large phased array antenna having several hundred of radiation elements.

Since the apparatus and method for correcting a phase according to the present invention can correct errors in various types of array antennas, the apparatus and method for correcting a phase according to the present invention can maximize antenna performance. Also, the apparatus and method for correcting a phase according to the present invention can reduce a cost for manufacturing an array antenna because it is not required to manufacture an array antenna with high precision if the apparatus and method according to the present invention is applied.

Since the apparatus and method for correcting a phase according to the present invention provide a function of automatically face to an arrival direction of a radio signal, it is possible to detect an arrival direction of a radio signal.

What is claimed is:

1. An apparatus for correcting a phase of a phased array antenna for receiving a radio signal, comprising:

a phased array antenna for receiving radio signals from a reference antenna, the phased array antenna including a plurality of radiation elements and combining power of the received radio signals;

a power dividing means for dividing the combined power of the received radio signals;

a voltage detecting means for detecting voltage values of the divided radio signals; and a phase controlling means for estimating an estimated phase error of each of the plurality of radiation elements that makes the detected voltage value maximum and controlling a phase of each respective radiation element of the phased array antenna using the estimated phase error.

2. The apparatus of claim 1, wherein the phase controlling means performs operations for correcting a phase error of the phased array antenna for receiving by randomly generating objects having phase information, detecting a total voltage value of signals received at the corrected phased array antenna, determining whether convergence condition is satisfied by the total voltage value, deciding the phase information as a final phase correction value if the convergence condition is satisfied, and repeating the operations from said correcting the phase error by generating an object having new phase information using previously detected voltage values if the convergence condition is not satisfied.

3. The apparatus of claim 2, wherein if the convergence condition is not satisfied, the phase controlling means repeats the operations from said correcting the phase error by selecting predetermined voltages in descending order from a largest voltage value from previously detected voltage values and generating an object having new phase information by crossbreeding the selected voltage values.

4. The apparatus of claim 3, wherein the phase controlling means determines that the convergence condition is satisfied if a difference between a current voltage value and a previous voltage value is in a predetermined error range, and the phase controlling means determines that the convergence condition is not satisfied if a difference between a current voltage value and a previous voltage value is not in a predetermined error range.

5. The apparatus of claim 1, wherein the phased array antenna for receiving includes:

a plurality of radiation elements for receiving a radio signal from the reference antenna;

a plurality of phase shifters for shifting each of phases of received radio signals from the plurality of radiation elements in response to the phase controlling means; and a power combining means for combining power of each of the phase-shifted radio signals from the plurality of phase shifters.

6. An apparatus for correcting a phase of a phased array antenna for transmitting a radio signal, comprising:

a phased array antenna for transmitting radio signals, the phased array antenna including a plurality of radiation elements;

a reference antenna for receiving the radio signal transmitted from the phased array antenna for transmitting;

a voltage detecting means for detecting voltage values of the radio signal received at the reference antenna; and a phase controlling means for estimating an estimated phase error of each of the plurality of radiation elements that makes the detected voltage value maximum and controlling a phase of each respective radiation element of the phased array antenna using the estimated phase error.

7. The apparatus of claim 6, wherein the phase controlling means performs operations for correcting a phase error of the phased array antenna for transmitting by randomly generating objects having phase information, detecting a voltage value of a signal received through the reference antenna and transmitted from the corrected phased array antenna for transmitting, determining whether convergence condition is satisfied by the detected voltage value, deciding the phase information as a final phase correction value if the convergence condition is satisfied, and repeating the operations from said correcting a phase error by generating an object having new phase information using previously detected voltage values if the convergence condition is not satisfied.

8. The apparatus of claim 7, wherein if the convergence condition is not satisfied, the phase controlling means repeats the operations from said correcting the phase error by selecting predetermined voltages in descending order from a largest voltage value from previously detected voltage values and generating an object having new phase information by crossbreeding the selected voltage values.

9. The apparatus of claim 8, wherein the phase controlling means determines that the convergence condition is satisfied if a difference between a current voltage value and a previous voltage value is in a predetermined error range, and the phase controlling means determines that the convergence condition is not satisfied if a difference between a current voltage value and a previous voltage value is not in a predetermined error range.

10. The apparatus of claim 6, wherein the phased array antenna for transmitting includes:

a power dividing means for receiving a transmission signal and dividing the transmission signal by a plurality of powers;

a plurality of phase shifters for shifting each of phases of the transmission signals from the plurality of power dividing means in response to the phase controlling means; and a plurality of radiation elements for radiating the plurality of phase-shifted transmitted signals from the plurality of phase shifters.

11. A method for correcting a phase of a phased array antenna, comprising:

generating objects having phase information used for correcting the phase of the phased array antenna;

correcting a phase error of the phased array antenna according to each of the phase information of the generated objects;

detecting a voltage value of a signal passing through the corrected phase array antenna and determining whether a predetermined convergence condition is satisfied by the detected voltage value or not;

deciding the phase information as a final phase correction value of the phased array antenna if the predetermined convergence condition is satisfied; and generating an object having new phase information using previously detected voltage values if the predetermined convergence condition is not satisfied and performing said correcting a phase error.

12. The method of claim 11, wherein in said generating an object having new phase information, predetermined voltages are selected from previously detected voltage values in descending order from a largest voltage value, an object having new phase information is generated by crossbreeding the selected voltage values, and said correcting a phase error is performed.

13. The method of claim 11, wherein said determining whether a predetermined convergence condition is satisfied includes:

determining that the convergence condition is satisfied if a difference between a current voltage value and a previous voltage value is in a predetermined error range; and determining that the convergence condition is not satisfied if a difference between a current voltage value and a previous voltage value is not in a predetermined error range.

* * * * *